US010121492B2

(12) United States Patent
Ryu et al.

(10) Patent No.: US 10,121,492 B2
(45) Date of Patent: *Nov. 6, 2018

(54) VOICE CONVERTING APPARATUS AND METHOD FOR CONVERTING USER VOICE THEREOF

(71) Applicant: SAMSUNG ELECTRONICS CO., LTD., Suwon-si (KR)

(72) Inventors: Jong-youb Ryu, Suwon-si (KR); Yoon-jae Lee, Seoul (KR); Seoung-hun Kim, Hwaseong-si (KR); Young-tae Kim, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/391,352

(22) Filed: Dec. 27, 2016

(65) Prior Publication Data

US 2017/0110143 A1 Apr. 20, 2017

Related U.S. Application Data

(63) Continuation of application No. 14/051,836, filed on Oct. 11, 2013, now Pat. No. 9,564,119.
(Continued)

(30) Foreign Application Priority Data

Oct. 12, 2012 (KR) ..... 10-2012-0113629
Sep. 16, 2013 (KR) ..... 10-2013-0111209

(51) Int. Cl.
*G10L 21/02* (2013.01)
*G10L 21/0364* (2013.01)
(Continued)

(52) U.S. Cl.
CPC ..... *G10L 21/0364* (2013.01); *G10L 13/02* (2013.01); *G10L 21/0232* (2013.01); *G10L 25/90* (2013.01)

(58) Field of Classification Search
CPC ..... G10L 19/26; G10L 19/265; G10L 21/00; G10L 21/003; G10L 21/013; G10L 21/02;
(Continued)

(56) References Cited

U.S. PATENT DOCUMENTS 4,610,022 A 9/1986 Kitayama et al.
6,122,384 A 9/2000 Mauro
(Continued)

FOREIGN PATENT DOCUMENTS

CN 1312938 A 9/2001
CN 1604186 A 4/2005
(Continued)

OTHER PUBLICATIONS

Communication, dated Jan. 7, 2014, issued by the European Patent Office in counterpart European Patent Application No. 13188466.0.
(Continued)

*Primary Examiner* — Qi Han
(74) *Attorney, Agent, or Firm* — Sughrue Mion, PLLC

(57) ABSTRACT

A voice converting apparatus and a voice converting method are provided. The method of converting a voice using a voice converting apparatus including receiving a voice from a counterpart, analyzing the voice and determining whether the voice abnormal, converting the voice into a normal voice by adjusting a harmonic signal of the voice in response to determining that the voice is abnormal, and transmitting the normal voice.

20 Claims, 9 Drawing Sheets

Related U.S. Application Data

(60) Provisional application No. 61/774,733, filed on Mar. 8, 2013.

(51) Int. Cl.
*G10L 25/90* (2013.01)
*G10L 21/0232* (2013.01)
*G10L 13/02* (2013.01)

(58) Field of Classification Search
CPC ..... G10L 21/0202; G10L 21/0205; G10L 21/0208; G10L 21/0316; G10L 21/0364; G10L 13/08; G10L 31/033; G10L 13/0335; G10L 13/10
USPC ..... 704/261, 227, 228, 268, 278
See application file for complete search history.

(56) References Cited

U.S. PATENT DOCUMENTS

| | | | | |
|---|---|---|---|---|
| 6,912,496 | B1 * | 6/2005 | Bhattacharya | G10L 19/087 704/228 |
| 6,952,668 | B1 | 10/2005 | Kapilow | |
| 7,191,134 | B2 | 3/2007 | Nunally | |
| 7,299,188 | B2 | 11/2007 | Gupta et al. | |
| 7,373,294 | B2 | 5/2008 | Cezanne et al. | |
| 7,509,255 | B2 | 3/2009 | Takeishi et al. | |
| 2001/0044721 | A1 | 11/2001 | Yoshioka et al. | |
| 2001/0044722 | A1 | 11/2001 | Gustafsson et al. | |
| 2003/0061047 | A1 | 3/2003 | Yoshioka et al. | |
| 2003/0182116 | A1 | 9/2003 | Nunally | |
| 2004/0006461 | A1 | 1/2004 | Gupta et al. | |
| 2004/0230421 | A1 | 11/2004 | Cezanne et al. | |
| 2005/0075860 | A1 | 4/2005 | Takeishi et al. | |
| 2007/0005357 | A1 * | 1/2007 | Moran | G10L 25/66 704/246 |
| 2012/0065978 | A1 | 3/2012 | Villavicencio | |

FOREIGN PATENT DOCUMENTS

| | | | |
|---|---|---|---|
| CN | 101808151 | A | 8/2010 |
| EP | 2 216 968 | A1 | 8/2010 |
| EP | 2 222 062 | A1 | 8/2010 |
| KR | 10-2011-0121883 | A | 11/2011 |
| WO | 2008/018653 | A1 | 2/2008 |
| WO | 2008/075305 | A1 | 6/2008 |

OTHER PUBLICATIONS

Fraj, Samia, et al., "Development and perceptual assessment of a synthesizer of disordered voices," The Journal of the Acoustical Society of America, vol. 132, No. 4, Oct. 1, 2012, pp. 2603-2615.
International Search Report (PCT/ISA/210), dated Feb. 26, 2014, issued by the International Searching Authority in counterpart International Patent Application No. PCT/KR2013/009102.
Manfredi, Claudia, et al., "Voice Quality Monitoring: a Portable Device Prototype," Engineering in Medicine and Biology Society, IEEE, EMBS Conference, Aug. 20-24, 2008, pp. 997-1000.
Written Opinion (PCT/ISA/237), dated Feb. 26, 2014, issued by the International Searching Authority in counterpart International Patent Application No. PCT/KR2013/009102.
Yumin Zeng et al., "Robust speaker recognition based on harmonic spectrum reconstruction of voiced speech", Journal of Southeast University (Natural Science Edition), vol. 138, No. 16, Nov. 2008, pp. 935-941. (7 pages total).
Communication dated Feb. 24, 2018 by the State Intellectual Property Office of P.R. China in counterpart Chinese Patent Application No. 201310478928.6.
Communication dated Sep. 17, 2018, issued by the State Intellectual Property Office of P.R. China in counterpart Chinese Application No. 201310478928.6.
Omori et al., "Acoustic Characteristics of Rough Voice: Subharmonics", Journal of Voice, vol. 11, No. 1, Dec. 1997, pp. 40-47 (8 pages total).
Bergan et al., "Perception of Pitch and Roughness in Vocal Signals with Subharmonics", Journal of Voice, vol. 15, No. 2, Dec. 2001, pp. 165-175 (11 pages total).
Nunez-Batalla et al., "The Effect of Anchor Voices and Visible Speech in Training in the GRABS Scale of Perceptual Evaluation of Dysphonia", Acta Otorrinolaringologica Espanola, 63(3), Jun. 2012, pp. 173-179 (7 pages total).
Wang, "Behavioral Science and Business Management", pp. 304-305, School of Management at Zhejiang University, Dec. 1984, (5 pages total).

* cited by examiner

ABNORMAL

NORMAL

ABNORMAL

VOICE CONVERTING APPARATUS AND METHOD FOR CONVERTING USER VOICE THEREOF

CROSS-REFERENCE TO RELATED APPLICATIONS

This application is a continuation of U.S. patent application Ser. No. 14/051,836, filed in the U.S. Patent and Trademark Office on Oct. 11, 2013, which claims priority from Korean Patent Application No. 10-2012-0113629, filed in the Korean Intellectual Property Office on Oct. 12, 2012, Korean Patent Application No. 10-2013-0111209, filed in the Korean Intellectual Property Office on Sep. 16, 2013, and U.S. Provisional Application No. 61/774,733, filed in the U.S. Patent and Trademark Office on Mar. 8, 2013, the disclosures of which are incorporated herein by reference in their entireties.

BACKGROUND

1. Field

Methods and apparatuses consistent with exemplary embodiments relate to voice converting, and more particularly, to a voice converting apparatus which analyzes a voice of counterpart during phone call, coverts the voice of the counterpart into a normal voice, and outputs the voice, and a method for converting a user voice thereof.

2. Description of the Related Art

Recently, due in part to an increase in air pollution, activities in restricted spaces, and use of mobile phones, some people suffer from a sore larynx and thereby experience change in their voices. Particularly, when a person's larynx is hurt due to any of a variety of reasons, a person's voice may change abnormally. Also, there are some people who naturally have what is spectrally considered to be an abnormal voice. Further, radio spectrum pollution, in the form of noise and loss of signal strength, may also distort a person's received voice such that appears abnormal.

Such an abnormal voice which may not be recognized properly may not only interfere with an attempt to have a smooth conversation with others, but may also cause discomfort and even misunderstandings.

For example, when an abnormal voice is heard during a phone call which may be performed through a communication terminal (for example, wired phone call, wireless phone call, etc.), a user may not recognize the voice properly and sometimes, it may not be possible to continue the conversation via phone.

Accordingly, a method and/or an apparatus that may help allow a user to have a smooth phone conversation with a counterpart who transmits an abnormal voice is desired.

SUMMARY

One or more exemplary embodiments relate to a voice converting apparatus which determines whether a voice is abnormal, and when it is determined that the voice is abnormal, converts the abnormal voice into a normal voice by adjusting a harmonic signal from the voice of the counterpart and provides the normal voice, and a method for converting a user voice thereof.

According to an aspect of an exemplary embodiment, there is provided a method of using a voice converting apparatus for voice conversion including receiving a voice from a counterpart, analyzing the voice and determining whether the voice abnormal, converting the voice into a normal voice by adjusting a harmonic signal of the voice in response to determining that the voice is abnormal, and transmitting the converted normal voice.

The determining may include extracting a voice parameter from the voice, and analyzing the extracted voice parameter and determining whether the voice is abnormal based on the voice parameter.

The voice parameter may include at least one of a pitch element of the voice, a Harmonic-to-Noise Ratio (HNR) of the voice, an open quotient of the voice, and a Grade, Roughness, Breathiness, Asthenia, Strain Scale (GRBAS) score of the voice.

The converting may include converting the voice into the normal voice by emphasizing a harmonic element of the voice and removing a sub-harmonic element of the voice.

The converting may include converting the voice into the normal voice by generating a harmonic signal in a high frequency band of the voice.

The converting the voice into the normal voice may be triggered on/off according to a user input.

The method may further include displaying a user interface configured to receive a user input for adjusting a conversion intensity of the voice into the normal voice, and setting the conversion intensity according to the user input received through the user interface. The converting may include converting the voice into the normal voice according to the set conversion intensity.

The method may further include storing information indicating that the voice is abnormal in response to determining that the voice is abnormal.

The converting may include converting the voice into the normal voice without determining whether the voice is abnormal in response to receiving information indicating that the voice is abnormal.

The method may further include outputting the voice immediately in response to determining that the voice is normal.

According to an aspect of another exemplary embodiment, there is provided a voice converting apparatus including a receiver configured to receive a voice from a counterpart, a voice determiner configured to analyze the voice and determine whether the voice is abnormal, a normal voice converter configured to convert the voice into a normal voice by adjusting a harmonic signal of the voice in response to determining that the voice is abnormal, and a transmitter configured to transmit the normal voice.

The voice determiner may include a parameter extractor configured to extract a voice parameter from the voice, and a parameter analyzer configured to analyze the extracted voice parameter and determine whether the voice is abnormal based on the voice parameter.

The voice parameter may include at least one of a pitch element of the voice, a Harmonic-to-Noise Ratio (HNR) of the voice, an open quotient of the voice, and a Grade, Roughness, Breathiness, Asthenia, Strain Scale (GRBAS) score of the voice.

The normal voice converter may convert the voice into the normal voice by emphasizing a harmonic element of the voice and removing a sub-harmonic element of the voice.

The normal voice converter may convert the voice into the normal voice by generating a harmonic signal in a high frequency band of the voice.

The apparatus may further include an input unit configured to receive a user input, wherein a function of converting the voice into the normal voice is triggered on/off according to a user input received through the input unit.

The apparatus may further include a display configured to display a user interface configured to receive a user input for adjusting a conversion intensity of the voice into the normal voice, wherein the normal voice converter converts the voice into the normal voice according to the conversion intensity that is set according to the user input received through the user interface.

The apparatus may further include a storage configured to store information indicating that the voice is abnormal in response to determining that the voice is abnormal.

The normal voice converter may convert the voice into the normal voice without determining whether the voice is abnormal in response to receiving information indicating that the voice is abnormal.

The voice output unit may output the voice immediately in response to determining that the voice is normal.

BRIEF DESCRIPTION OF THE DRAWINGS

The above and/or other aspects will be more apparent by describing certain exemplary embodiments with reference to the accompanying drawings, in which.

DETAILED DESCRIPTION

It should be observed the method steps and system components have been represented by conventional symbols in the figure, showing only specific details which are relevant for an understanding of the present disclosure. Further, details may be readily apparent to person ordinarily skilled in the art may not have been disclosed. In the present disclosure, relational terms such as first and second, and the like, may be used to distinguish one entity from another entity, without necessarily implying any actual relationship or order between such entities.

Figure 1:
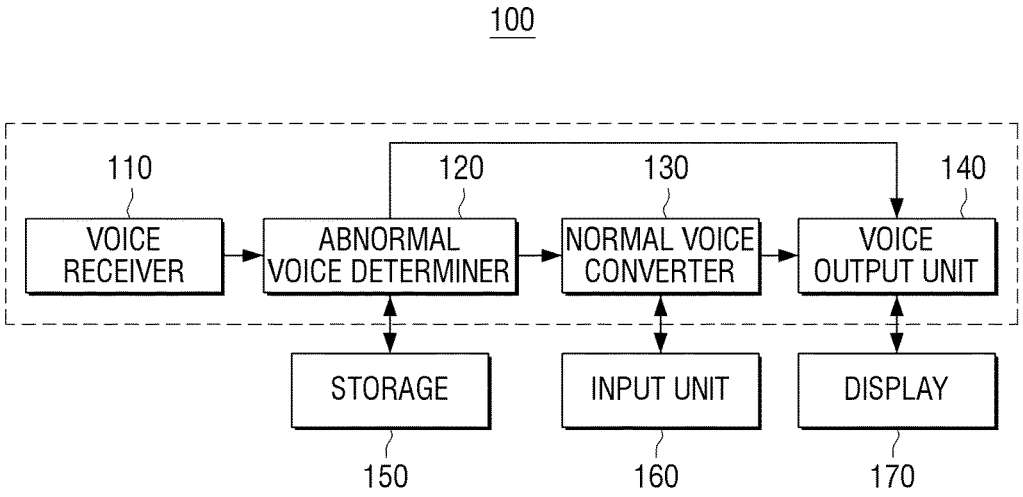
FIG. 1 is a block diagram illustrating configuration of a voice converting apparatus according to an exemplary embodiment.

FIG. 1 is a block diagram illustrating configuration of a voice converting apparatus 100 according to an exemplary embodiment. As illustrated in FIG. 1, the voice converting apparatus 100 may include a voice receiver 110, an abnormal voice determiner 120, a normal voice converter 130, a voice output unit 140, a storage 150, an input unit 160, and a display 170. The voice converting apparatus 100, according to an exemplary embodiment, may be a smart phone, but is not limited thereto. The voice converting apparatus 100 may be realized as various apparatuses having a phone call function such as a wired telephone, a Personal Digital Assistant (PDA), a tablet PC, a smart television, and so on.

The voice receiver 110 receives a voice signal of counterpart. Specifically, the voice receiver 110 may receive a voice signal of counterpart during phone call (for example, a voice call, a video call, etc.).

The abnormal voice determiner 120 analyzes a voice signal that is received from a counterpart and determines whether the voice of the counterpart is abnormal or normal. An exemplary embodiment of the abnormal voice determiner 120 will be described in detail with reference to FIG. 2.

Figure 2:
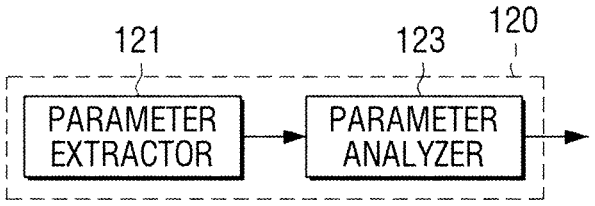
FIG. 2 is a block diagram illustrating configuration of an abnormal voice determiner according to an exemplary embodiment.

As illustrated in FIG. 2, the abnormal voice determiner 120 according to an exemplary embodiment may comprise a parameter extractor 121 and a parameter analyzer 123.

The parameter extractor 121 may extract a voice parameter from the received voice of the counterpart. In this case, the voice parameter may include at least one of a pitch element of the counterpart voice, a Harmonic-to-Noise Ratio (HNR) of the counterpart voice, an open quotient of the counterpart voice, and a Grade, Roughness, Breathiness, Asthenia, Strain Scale (GRBAS) score of the counterpart voice.

The pitch element of the counterpart voice represents the vocal cords frequency of vibration of the counterpart, and is used to detect abnormal vibration. The Harmonic-to-Noise Ratio (HNR) of the counterpart voice represents a harmonic to noise ratio of the counterpart voice, and is used to determine whether the voice is abnormal according to the noise ratio. The open quotient of the counterpart voice is a parameter regarding the ratio of time when the vocal cords are open during the vibration frequency of the vocal cords, and may be inferred from an energy ratio of the first harmonic signal and the second harmonic signal. The GRBAS score of the counterpart voice is an algorithm for determining characteristics of an abnormal voice, and include scores of 0-3 regarding G (grade, general impression), R (roughness, rough sound and irregular vibration of vocal cords), B (breathiness), A (asthenia), and S (strain).

The parameter analyzer 123 may analyze a voice parameter extracted by the parameter extractor 121 and determine whether a voice of counterpart is abnormal.

Figure 3A:
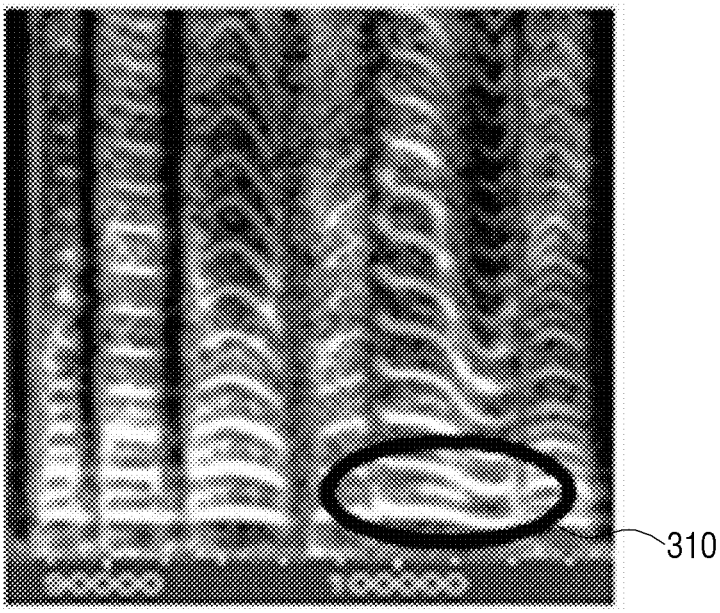
FIGS. 3A through 3F are views provided to explain a voice parameter with an abnormal voice according to various exemplary embodiments.

For example, if the voice parameter is the pitch element of a counterpart voice, the parameter analyzer 123 may monitor whether a sub-harmonic element is generated by analyzing the pitch element of the counterpart voice. Specifically, when the voice parameter is a pitch element of counterpart voice, the parameter analyzer 123 may analyze the pitch element of the counterpart voice and monitor whether a sub-harmonic element occurs. More specifically, as illustrated in area 310 of FIG. 3A, when a sub-harmonic signal is generated between two harmonic elements, the parameter analyzer 123 may determine that the sub-harmonic signal is an abnormal voice if there is stronger sub-harmonic element which is inferred to be a noise element. In this case, the pitch element of the counterpart voice is changed due to the sub-harmonic signal and thus, the parameter analyzer 123 may determine the counterpart voice as an abnormal voice if the pitch is more than twice as high as a normal voice.

Figure 3B:
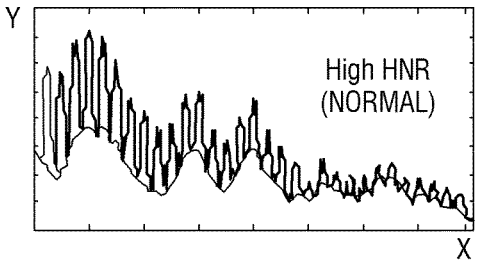
Figure 3C:
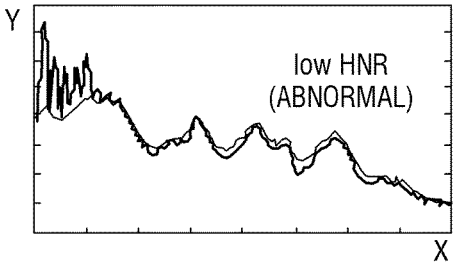
Figure 3D:
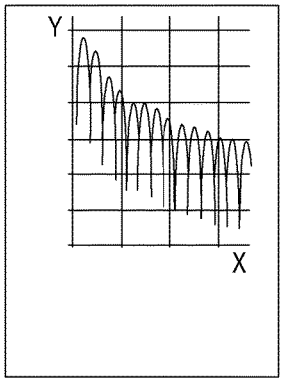
Figure 3E:
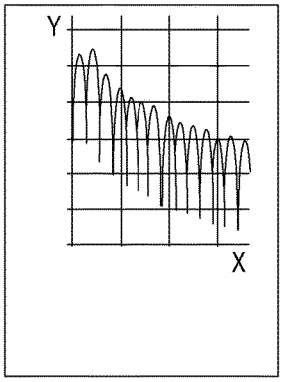
Figure 3F:
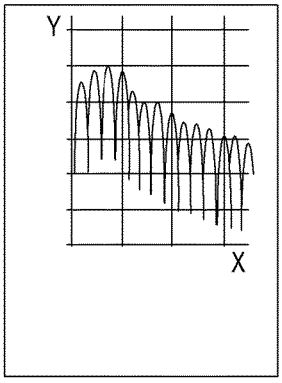

Alternatively, if the voice parameter is a harmonic-to-noise ratio, the parameter analyzer 123 may determine whether the harmonic-to-noise ratio is higher than a predetermined value. For example, as illustrated in FIG. 3B, when the harmonic-to-noise ratio is higher than a predetermined value, the parameter analyzer 123 may determine that the counterpart voice is a normal signal, but alternatively as illustrated in FIG. 3C, when the harmonic-to-noise ratio is less than a predetermined value, the parameter analyzer 123 may determine that the counterpart voice is an abnormal voice. Further, as illustrated in FIGS. 3D through 3F, the harmonic-to-noise ratio may contain a bigger difference between a normal voice and an abnormal voice in a high frequency band, and thus the parameter analyzer 123 may determine a harmonic-to-noise ratio by analyzing a frequency band which is higher than a predetermined frequency band when determining whether a normal voice or an abnormal voice is detected.

If the voice parameter is an open quotient, the parameter analyzer 123 may calculate an energy ratio of the first harmonic signal element and the second harmonic signal element, and determine whether the counterpart voice is normal or abnormal. Specifically, if an open quotient is within a predetermined scope (for example, 0.4-0.6), the parameter analyzer 123 may determine that the counterpart voice is normal. For example, when the open quotient is calculated as 0.5 as illustrated in the graph of FIG. 3E, the parameter analyzer 123 may determine that the counterpart voice is normal. However, when the open quotient is out of a predetermined range, the parameter analyzer 123 may determine that the counterpart voice is abnormal. That is, if the open quotient is too large or too small, it is highly likely that the counterpart voice is a deafening or a dry voice, the parameter analyzer 123 may therefore determine that the counterpart voice is abnormal. For example, if the open quotient (0.7) is higher than a predetermined scope or the open quotient (0.3) is less than a predetermined scope as illustrated in the graph of FIG. 3D, the parameter analyzer 123 may determine that the counterpart voice is abnormal.

Further, if the voice parameter is a GRBAS score, and at least one of G (grade, general impression), R (roughness, rough sound and irregular vibration of vocal cords), B (breathiness), A (asthenia), and S (strain) is higher than a predetermined value, the parameter analyzer 123 may determine that the counterpart voice is abnormal.

Meanwhile, the above-described voice parameters are only examples, and whether a counterpart voice is abnormal may be determined based on other voice parameters.

When it is determined that a counterpart voice is abnormal, the abnormal voice determiner 120 may output the counterpart voice to the normal voice converter 130, and when it is determined that a counterpart voice is normal, the abnormal voice determiner 120 may output the counterpart voice to the voice output unit 140.

If a voice signal of a counterpart whose voice is determined to be abnormal and is received, the normal voice converter 130 converts the counterpart voice to a normal voice. Specifically, the normal voice converter 130 may convert an abnormal voice to a normal voice by adjusting a harmonic element of the counterpart voice.

Figure 4A:
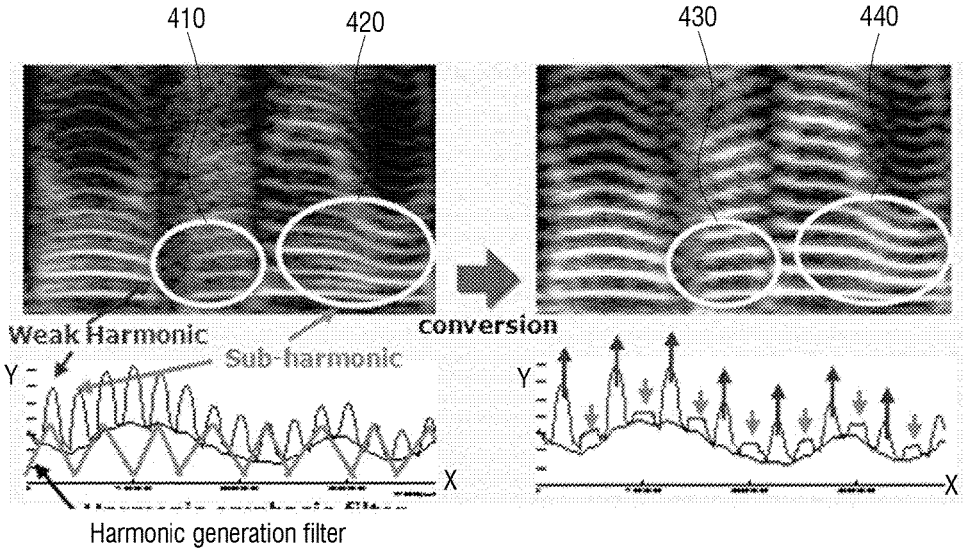
FIGS. 4A through 4B are views provided to explain a method for converting an abnormal voice to a normal voice according to various exemplary embodiments.

For example, the counterpart voice, which is determined to be abnormal, may include a weak harmonic signal as illustrated in area 410 of FIG. 4A, or may include a sub-harmonic signal which is determined to be a noise element between harmonic signals as illustrated in area 420 of FIG. 4A. Accordingly, the normal voice converter 130 may emphasize the weak harmonic signal element as illustrated in area 430 of FIG. 4A, or may remove the sub-harmonic signal between harmonic signals as illustrated in area 440 of FIG. 4A.

Figure 4B:
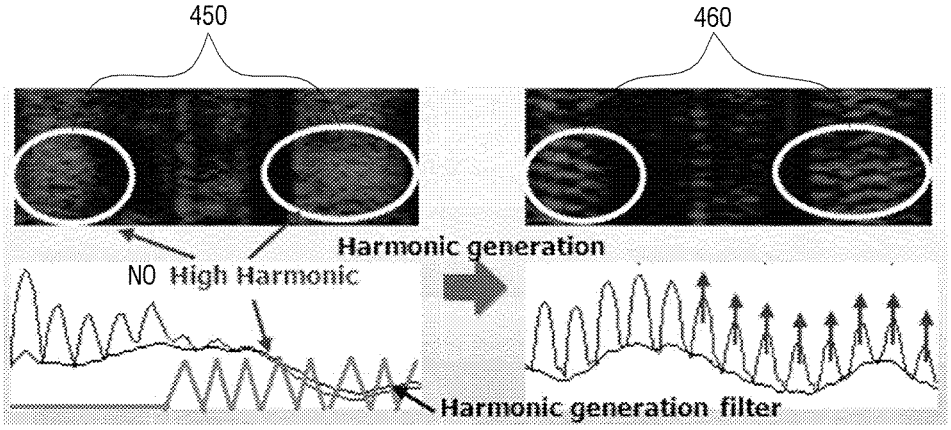

Further, the counterpart voice may be determined to be abnormal because it may not include a harmonic signal as illustrated in area 450 of FIG. 4B. Accordingly, the normal voice converter 130 may generate a harmonic signal using a harmonic generation filter as illustrated in area 460 of FIG. 4B.

That is, as described above, the normal voice converter 130 may convert an abnormal voice into a normal voice by generating or emphasizing a harmonic element, or by removing a sub-harmonic element.

According to another exemplary embodiment, generating or emphasizing a harmonic element or removing a sub-harmonic element may be achieved as follows. Particularly, a determination of a primary voice harmonic with a frequency and phase may be established. Then it may be possible to generate an oscillating gain signal with the frequency and phase of the primary voice harmonic, and the generated oscillating gain signal may be added to the primary voice harmonic.

Figure 5:
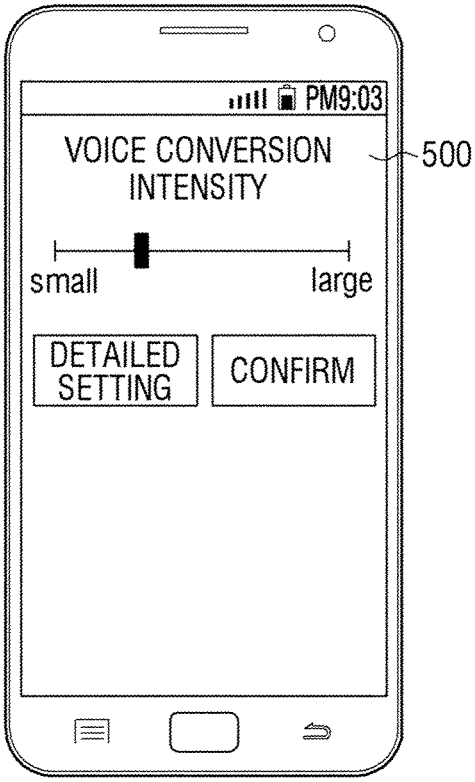
FIG. 5 is a view illustrating user interface for adjusting conversion intensity according to an exemplary embodiment.

Further, according to another exemplary embodiment, the normal voice converter 130 may adjust a conversion intensity according to a user input, which may also be referred to as an input user command, that is received through a user interface for adjusting the conversion intensity for converting an abnormal voice into a normal voice. For example, as illustrated in FIG. 5, if a voice conversion intensity is adjusted through the UI 500 for adjusting the voice conversion intensity, the normal voice converter 130 may convert an abnormal voice into a normal voice according to the adjusted voice conversion intensity selected by the user. Particularly, the stronger the selected voice conversion intensity is, the more the normal voice converter 130 may emphasize a harmonic signal, and the more completely the normal voice converter 130 may remove a sub-harmonic signal. On the other hand, the weaker the selected voice conversion intensity is, the less the normal voice converter 130 may emphasize a harmonic signal, and the normal voice converter 130 may not remove a sub-harmonic signal completely and instead, may reduce the sub-harmonic signal to a predetermined ratio.

In addition, the normal voice converter 130 may convert only part of the characteristics of an abnormal voice to a normal voice. For example, the normal voice converter 130 may remove only a sub-harmonic element while maintaining a harmonic element, or may emphasize only a harmonic element while maintaining a sub-harmonic element.

That is, by setting a conversion intensity and method according to a user input, the user may convert a counterpart voice to a normal voice so that the voice is suitable for the user.

The feature that the normal voice converter 130 converts an abnormal voice to a normal voice by adjusting a harmonic element of counterpart is only an example, and an abnormal voice may be converted into a normal voice using another method.

In addition, the normal voice converter 130 may output a converted normal voice to the voice output unit 140.

The voice output unit 140 may output a counterpart voice which is output through the abnormal voice determiner 120 or a counterpart voice which is output through the normal voice converter 130. In this case, the voice output unit 140 may be a speaker, but is not limited thereto. The voice output unit 140 may be realized as an output terminal which is connectable to an external apparatus.

The storage 150 stores various programs and data to control the voice converting apparatus 100. In particular, the storage 150 may store a module to determine whether a voice is normal or abnormal.

When it is determined that a voice is abnormal, the storage 150 may store information indicating that the voice is abnormal along with particular information about how to normalize the voice through processing and converting. In this case, the storage 150 may also store information indicating whether a voice is normal in an address book where information regarding a telephone number, location, or other identification information of the counterpart is stored.

Thus, a voice may then be identified using the stored information indicating that the voice is abnormal and the specific voice normalization adjustment information may also be provided and then applied to the received voice. For example, when a phone call is performed with a counterpart whose information stored indicates that the voice of the counterpart is abnormal, the voice converting apparatus 100 may not determine whether the voice of the counterpart is abnormal and instead, convert the voice of the counterpart directly into a normal voice based on the stored information.

The input unit 160 may receive a user command to control the voice converting apparatus 100. Specifically, the input unit 160 may receive a user command to adjust a voice conversion intensity, a user command to turn on/off the function of converting an abnormal voice of counterpart to a normal voice, and so on.

The display 170 outputs image data. In particular, the display 170 may display a UI 500 for adjusting a voice conversion intensity as illustrated in FIG. 5.

As described above, according to the voice converting apparatus 100, a user may perform a smooth phone conversion even with a counterpart who has an abnormal voice which cannot be recognized easily.

The voice converting apparatus 100 may turn on or off the function of converting an abnormal voice of counterpart into a normal voice (hereinafter, referred to as "a voice converting function") according to a user setting. That is, if the voice converting function is turned on, the voice converting apparatus 100 may analyze a voice of counterpart and convert the voice into a normal voice automatically. However, if the voice converting function is turned off, the voice converting apparatus 100 may not analyze a voice of counterpart and convert the voice into a normal voice until a user command is input.

Figure 6:
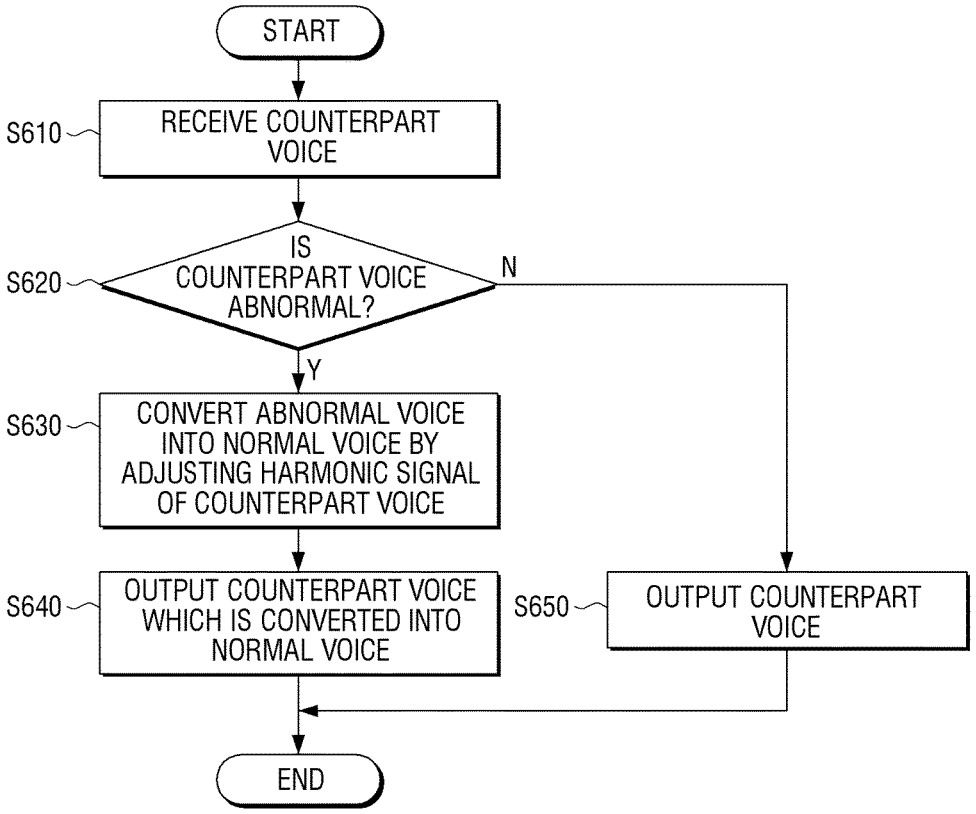
FIG. 6 is a flowchart provided to explain a method for converting a voice according to an exemplary embodiment.

Hereinafter, a voice converting method according to an exemplary embodiment will be explained with reference to FIG. 6.

Initially, the voice converting apparatus 100 may receive a voice of counterpart (S610). In this case, the voice converting apparatus 100 may perform a voice call or a video call with a communication terminal of counterpart. In addition, the voice converting function of the voice converting apparatus 100 may be turned on. According to another exemplary embodiment, the voice may be received through a local microphone configured to receive a counterpart voice locally which it may then detect, process, and output to the user of the local apparatus which received the voice through the local microphone. Further, according to another exemplary embodiment, the voice may be received from the user and converted into a normal voice locally before transmitting it over a cellular network to an intended listening counterpart.

Subsequently, the voice converting apparatus 100 determines whether the received voice of the counterpart is an abnormal voice (S620). In this case, the voice converting apparatus 100 may extract a voice parameter of the received voice of the counterpart, analyze the extracted voice parameter, and determine whether the voice of the counterpart is an abnormal voice. In this case, the voice parameter may include at least one of a pitch element of the counterpart voice, a Harmonic-to-Noise Ratio (HNR) of the counterpart voice, an open quotient of the counterpart voice, and a GRBAS score of the counterpart voice.

If it is determined that the counterpart voice is an abnormal voice (S620-Y), the voice converting apparatus 100 converts the abnormal voice into a normal voice by adjusting a harmonic signal of the counterpart voice (S630). Specifically, the voice converting apparatus 100 may emphasize a harmonic signal of the counterpart voice, and may convert an abnormal voice into a normal voice by removing a sub-harmonic signal which exists between harmonic signals of the counterpart voice. In this case, the voice converting apparatus 100 may set a conversion intensity and method according to a user input.

Subsequently, the voice converting apparatus 100 outputs the voice of counterpart which has been converted into a normal voice (S640).

Alternatively, if it is determined that the counterpart voice is not an abnormal voice (S650-N), the voice converting apparatus 100 may output the counterpart voice immediately (S640).

As described above, according to various exemplary embodiments, a user may perform a smooth local or phone conversion even with a counterpart who has an abnormal voice which cannot be recognized easily.

A program code to perform the voice converting method according to the various exemplary embodiments may be stored in a non-transitory computer readable medium. The non-transitory recordable medium refers to a medium which may store data semi-permanently rather than storing data for a short time such as a register, a cache, and a memory and may be readable by an apparatus. Specifically, the above-mentioned various applications or programs may be stored in a non-temporal recordable medium such as CD, DVD, hard disk, Blu-ray disk, USB, memory card, and ROM and provided therein The foregoing embodiments and advantages are merely exemplary and are not to be construed as limiting the inventive concept. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A method of converting a voice using a voice converting apparatus, the method comprising:

receiving a voice;

extracting, by a parameter extractor of the voice converting apparatus, a first harmonic element and a second harmonic element from the voice;

analyzing, by a parameter analyzer of the voice converting apparatus, the voice to determine an open quotient time of the voice based on an energy ratio of a first energy level of the first harmonic element to a second energy level of the second harmonic element;

determining, by the parameter analyzer, whether the open quotient time is within a predetermined range;

in response to determining that the open quotient time is beyond the predetermined range, determining that the voice is abnormal by the parameter analyzer; and adjusting the first harmonic element and the second harmonic element of the voice in response to the voice being determined to be abnormal.

2. The method as claimed in claim 1, wherein the adjusting comprises:

in response to the voice determined to be abnormal, adjusting a conversion intensity of the voice by emphasizing the first harmonic element and the second harmonic element of the voice and reducing a sub-harmonic element that exists between the first harmonic element and the second harmonic element, so as to convert the voice determined as being abnormal into a normal voice.

3. The method as claimed in claim 1, wherein the analyzing comprises:

extracting at least one pitch element from the voice; and analyzing the at least one pitch element to determine whether a sub-harmonic element exists between the first harmonic element and the second harmonic element of the voice.

4. The method as claimed in claim 1, further comprising:

determining that the voice is abnormal in response to a Harmonic-to-Noise Ratio (HNR) of the voice being greater than a predetermined noise threshold.

5. The method as claimed in claim 2, wherein the adjusting comprises:

removing the sub-harmonic element from the voice.

6. The method as claimed in claim 2, wherein the adjusting comprises:

adjusting the voice by generating a harmonic signal in a high frequency band of the voice.

7. The method as claimed in claim 2, wherein the adjusting is triggered on or off according to a user input.

8. The method as claimed in claim 1, further comprising:

displaying a user interface configured to receive a user input for adjusting a conversion intensity of the voice; and setting the conversion intensity according to the user input received through the user interface, wherein the adjusting comprises adjusting the voice based on the set conversion intensity.

9. The method as claimed in claim 1, further comprising:

storing information indicating that the voice is abnormal in response to determining that the voice is abnormal.

10. The method as claimed in claim 1, further comprising:

determining the voice is normal by the parameter analyzer in response to determining that a sub-harmonic element does not exist between the first harmonic element and the second harmonic element, or in response to determining that the sub-harmonic element exists and a value of the sub-harmonic element being lesser than and equal to a predetermined value; and outputting the voice immediately in response to determining that the voice is normal.

11. A voice converting apparatus, comprising:

a receiver configured to receive a voice;

a parameter extractor configured to extract a first harmonic element and a second harmonic element from the voice; and a parameter analyzer configured to analyze the voice to determine an open quotient time of the voice based on an energy ratio of a first energy level of the first harmonic element to a second energy level of the second harmonic element, determine whether the open quotient time is within a predetermined range, and in response to determining that the open quotient time is beyond the predetermined range, determine that the voice is abnormal; and a voice converter configured to adjust the first harmonic element and the second harmonic element of the voice in response to the voice being determined to be abnormal.

12. The apparatus as claimed in claim 11, wherein the voice converter is further configured, in response to the voice determined to be abnormal, to adjust a conversion intensity of the voice by emphasizing the first harmonic element and the second harmonic element of the voice and reducing a sub-harmonic element that exists between the first harmonic element and the second harmonic element, so as to convert the voice determined as being abnormal into a normal voice.

13. The apparatus as claimed in claim 11, wherein the parameter extractor is further configured to extract at least one pitch element from the voice, wherein the parameter analyzer analyzes the at least one pitch element to determine whether a sub-harmonic element exists between the first harmonic element and the second harmonic element of the voice.

14. The apparatus as claimed in claim 11, wherein the parameter analyzer is further configured to determine that the voice is abnormal in response to a Harmonic-to-Noise Ratio (HNR) of the voice being greater than a predetermined noise threshold.

15. The apparatus as claimed in claim 12, wherein the voice converter is further configured to remove the sub-harmonic element from the voice.

16. The apparatus as claimed in claim 12, wherein the voice converter is further configured to adjust the voice by generating a harmonic signal in a high frequency band of the voice.

17. The apparatus as claimed in claim 12, further comprising:

an input unit configured to receive a user input, wherein the user input triggers the normal-voice converter to adjust the voice.

18. The apparatus as claimed in claim 11, further comprising:

a display configured to display a user interface configured to receive a user input for adjusting a conversion intensity of the voice, wherein the voice converter is further configured to adjust the voice based on the conversion intensity that is set according to the user input.

19. The apparatus as claimed in claim 11, further comprising:

a storage configured to store information indicating that the voice is abnormal in response to determining that the voice is abnormal.

20. The apparatus as claimed in claim 11, wherein the parameter analyzer is further configured to determine that the voice is normal in response to determining that a sub-harmonic element does not exist between the first harmonic element and the second harmonic element, or in response to determining the sub-harmonic element exists and a value of the sub-harmonic element being lesser than and equal to a predetermined value, and wherein the apparatus further comprises a voice output unit configured to output the voice immediately in response to the voice being determined to be normal.

* * * * *